US006224500B1

(12) United States Patent
Mizohata

(10) Patent No.: US 6,224,500 B1
(45) Date of Patent: May 1, 2001

(54) GOLF TEE

(76) Inventor: Kiyomi Mizohata, 6-15, Inadahonmachi 1-chome, Higashiosaka-shi, Osaka-fu (JP)

( * ) Notice: Subject to any disclaimer, the term of this patent is extended or adjusted under 35 U.S.C. 154(b) by 0 days.

(21) Appl. No.: 09/388,795

(22) Filed: Sep. 2, 1999

(30) Foreign Application Priority Data

| | | |
|---|---|---|
| Sep. 7, 1998 | (JP) | 10-252115 |
| Oct. 20, 1998 | (JP) | 10-298282 |
| Feb. 1, 1999 | (JP) | 11-024064 |

(51) Int. Cl.[7] ..... A63B 57/00
(52) U.S. Cl. ..... 473/396; 473/401
(58) Field of Search ..... 473/387–403

(56) References Cited

U.S. PATENT DOCUMENTS

| | | | | |
|---|---|---|---|---|
| 1,542,505 | * | 6/1925 | Jacobus | 473/402 |
| 1,588,038 | * | 6/1926 | Miller | 473/402 |
| 1,616,059 | * | 2/1927 | Mulvehill | 473/394 |
| 1,846,407 | * | 2/1932 | Thompson | 473/391 |
| 1,981,810 | * | 11/1934 | Parkhurst | 473/402 |
| 3,414,268 | * | 12/1968 | Chase | 473/396 |
| 3,690,676 | * | 9/1972 | Costa | 473/398 |
| 4,893,818 | * | 1/1990 | Liccardello | 473/396 |
| 5,679,081 | * | 10/1997 | Santilli | 473/391 |
| 5,690,563 | * | 11/1997 | Gammon | 473/399 |

* cited by examiner

*Primary Examiner*—Steven Wong
(74) *Attorney, Agent, or Firm*—Keating & Bennett, LLP

(57) ABSTRACT

A golf tee includes a shaft-shaped wooden base or leg. A ball receiving part formed of a plastic material is removably installed on an upper end of the base such that a golf ball can be placed on the ball receiving part. A plurality of substantially circular through-holes are formed through the ball receiving part. A cylindrical connection portion is formed integrally with the ball receiving part. Linear projection portions are formed on an inner wall of the connection portion such that each projection portion is triangular in section and extends continuously in an insertion-removal direction of the base. The projection portion is arranged such that as the level of the projection portion becomes nearer to an innermost end of the connection portion, a projection height thereof from the inner wall of the connection portion becomes increasingly larger. Therefore, as the level of the projection portion becomes nearer to the innermost end of the connection portion, the inner diameter of the projection portion becomes decreasingly smaller. A through-hole provides communication between a ball receiving surface of the ball receiving part and the interior of the connection portion with each other in the thickness direction of the ball receiving part.

8 Claims, 7 Drawing Sheets

GOLF TEE

BACKGROUND OF THE INVENTION

1. Field of the Invention

The present invention relates to a golf tee.

2. Description of the Prior Art

A one-piece plastic or wooden golf tee is known.

However, the conventional one piece plastic golf tee is not adapted to naturally decompose. Thus, if a golfer leaves such a golf tee on a golf course, the conventional golf tee pollutes the natural environment thereof. Further, the conventional one-piece plastic and wooden golf tee do not facilitate hitting a golf ball a long distance.

SUMMARY OF THE INVENTION

In order to overcome the problems described above, preferred embodiments of the present invention provide a golf tee which does not pollute the natural environment of a golf course and also allows a player to hit a golf ball a long distance.

A golf tee according to a preferred embodiment of the present invention preferably includes a base having a narrow-shaft shape and having a lower end adapted to be inserted into the ground, and a ball receiving part which is removably installed on an upper end of the base to support a golf ball thereon. Because the base of the golf tee is shaft-shaped, the golf tee can absorb an impact applied thereto and applies a low resistance to a golf club when a golf ball is hit with the golf club. Thus, a player can swing the head of the golf club to an appropriate extent and consequently, hit a golf ball a long distance. Because the base is removable from the ball receiving part, the ball receiving part can be used repeatedly even though the base is broken.

Thus, the golf tee according to preferred embodiments of the present invention is economical. Further, the base and the ball receiving part can be kept and carried separately. Also, because the base has a narrow shaft-shape, the golf tee looks as though it floats in the air when a golfer tees off, which allows the golfer to hit a golf ball easily. Further, because the golf tee has a narrow shaft-shape, it does not damage a blade of a lawn mower if it is left on the golf course.

It is preferable that the ball receiving part has a plurality of through-holes and/or a plurality of concave portions formed thereon. In this case, it is possible to conserve the resin material used to form the ball receiving part. It is preferable to use biodegradably decomposable resin for the ball receiving part in order to allow the golf tee to have improved biodegradably decomposable property. In the case where the through-hole is formed through the ball receiving part, air resistance is increasingly applied thereto. Thus, the golf tee can be prevented from flying far after a golfer swings.

The base preferably has a plurality of cut-out portions formed thereon so that the base can be cut to have a desired length when the golf tee is used. In this case, it is possible to adjust the length of the base as desired and a golfer can tee off at a desired height.

It is preferable that the base is made of a dyed wooden material. This is because the wooden material is easily naturally decomposed. Coloring of the base with dye does not form a film on the surface thereof, unlike painting on the surface thereof. Therefore, the dye does not prevent the base from absorbing water and thus, does not prevent the base from being naturally decomposed.

It is preferable that the ball receiving part has a substantially cylindrical connection portion for connecting the ball receiving part and the base with each other. The ball receiving part also preferably includes a projection portion provided on an inner wall of the connection portion to securely fasten the base to the connection portion. In this case, the base and the ball receiving part are connected with each other by inserting the base into the connection portion. The projection portion formed on the inner wall of the connection portion is pressed tight against the periphery of the base, thus, securely fastening the base to the connection portion.

The projection portion is arranged such that as a level of the projection portion becomes nearer to an innermost end of the connection portion, a projection height thereof from an inner wall of the connection portion becomes increasingly larger. In this case, even though there is a variation in the thickness of the base, the base can be securely fixed to the connection portion. That is, when the height of the projection portion from the inner wall of the connection portion is small, the inner diameter of the connection portion is large, whereas when the height thereof from the inner wall of the connection portion is large, the inner diameter of the connection portion is small. Thus, when the base is inserted into the connection portion, the base is caught by the projection portion at a region thereof having a height corresponding to the thickness of the base. Accordingly, even though there is a variation in the thickness of the base, the base can be securely fixed to the connection portion. Consequently, the base is not required to have a high degree of dimensional accuracy, which makes it easy to manufacture the base.

It is preferable that a through-hole is formed to communicate a ball receiving surface of the ball receiving part and an interior of the connection portion with each other in a thickness direction of the ball receiving part. In this case, the air inside of the connection portion flows through the through-hole. Thus, it is easy to insert the base into the connection portion and remove the base therefrom. The through-hole allows the base to be pressed out from the connection portion using a tool or object such as a narrow needle-shaped member by inserting it into the connection portion through the through-hole.

The ball receiving part preferably has a substantially concave portion that is substantially circular in plan view and coaxial with a ball receiving surface of the ball receiving part disposed on a bottom portion of the ball receiving part.

The ball receiving part is relatively thin and has a plurality of ribs extending radially from an approximate center of the ball receiving part along a curved surface thereof.

With these preferred embodiments, it is possible to reduce the amount of resin to be used for the ball receiving part without reducing the strength thereof. Therefore, it is possible to reduce the volume of the ball receiving part and improve the biodegradable decomposability thereof. Further, it is possible to conserve the amount of resin material used to form the ball receiving part.

The above and further elements, features, aspects, and advantages of the present invention will be more fully apparent from the following detailed description of preferred embodiments thereof with reference to the accompanying drawings.

DETAILED DESCRIPTION OF PREFERRED EMBODIMENTS

Figure 1:
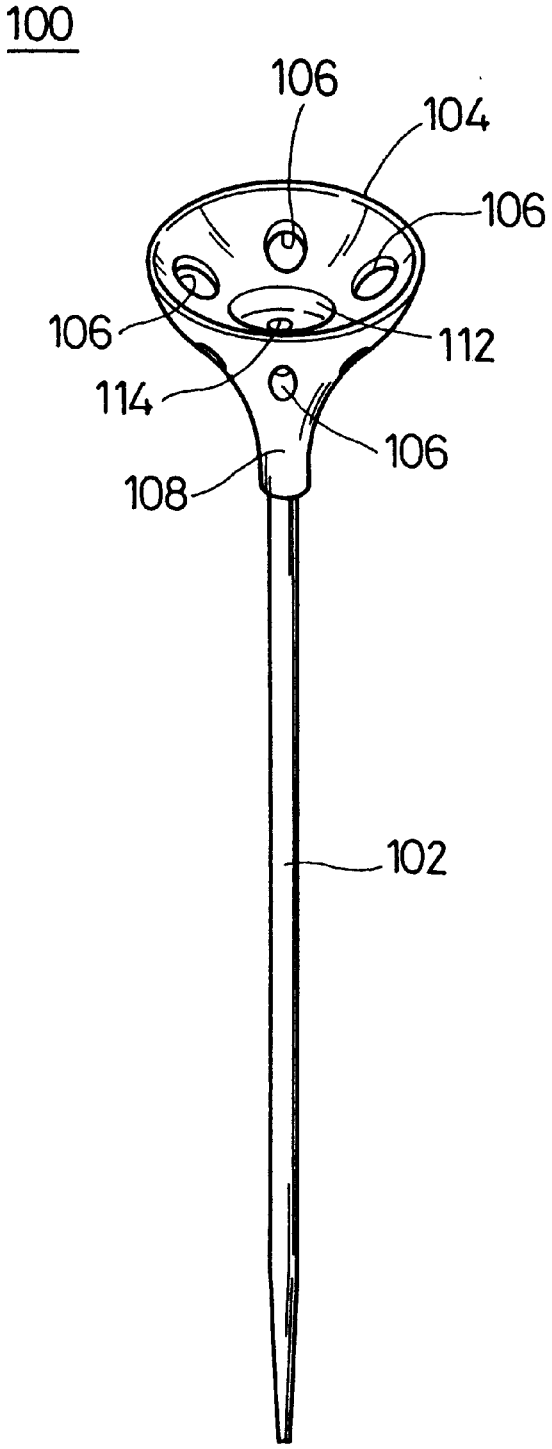
FIG. 1 is a perspective view showing a golf tee according to a preferred embodiment of the present invention.

FIG. 1 is a perspective view showing a golf tee according to a preferred embodiment of the present invention.

A golf tee 100 includes a shaft-shaped wooden base 102. A white birch or other suitable wooden material is preferably used as the material of the base 102. The base 102 is inserted into the ground from its lower end which is shaped in approximately a truncated cone to prevent a user from being injured by the lower end. Because the base 102 has a narrow long shaft, the golf tee 100 can be easily inserted into the ground.

In coloring the base 102, it is preferably dyed with water-based dye. Dying of the base 102 with the water-based dye does not affect or inhibit the water absorbing property of the base 102 and thus, allows the base 102 to be biodegraded readily, whereas painting on the surface of the base 102 forms a film on the surface thereof and prevents biodegradation.

A ball receiving part 104 preferably formed of a plastic material is removably installed on the upper end of the base 102. The ball receiving part 104 is constructed such that a golf ball can be placed on the ball receiving part 104. A plurality of circular through-holes 106 are preferably formed through the ball receiving part 104. Thus, it is possible to decrease the volume of the ball receiving part 104 and thereby conserve the amount of resin used to form the ball receiving part 104.

The golf tee 100 may be hit and travel a large distance when a golf ball placed thereon is hit. At that time, air is released through the through-hole 106. Thus, the golf tee 100 can be prevented from being moved and traveling very far.

The ball receiving part 104 may be shaped in the form of a basket, a bowl or the like. The number of the through-holes 106 and the size thereof can be selected in a desired range, provided that the ball receiving part 104 is strong enough to withstand use. The through-hole 106 is preferably substantially circular in this preferred embodiment, but may be substantially rectangular or other suitable shape.

The upper surface of the ball receiving part 104 of the golf tee 100 for receiving a golf ball is preferably frosted so as to have a matted surface finish. This is to allow a material of the ball receiving part 104 to easily bite into the surface of a die in molding the material and allow finish work to be accomplished easily, with the material of the ball receiving part 104 attaching to the die in removing a spool or a burr after a molding process finishes. The outer surface of the ball receiving part 104 is preferably lapped to have a mirror-like finish.

Figure 2:
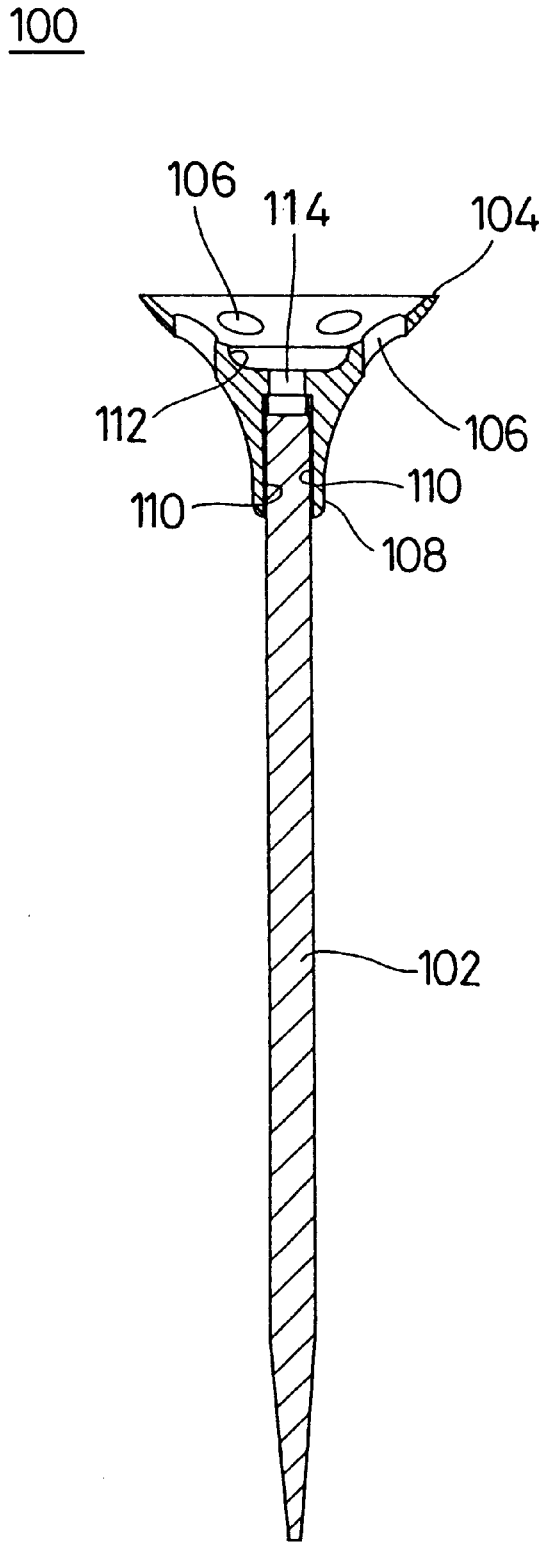
FIG. 2 is a longitudinal sectional view showing the golf tee shown in FIG. 1.
Figure 3:
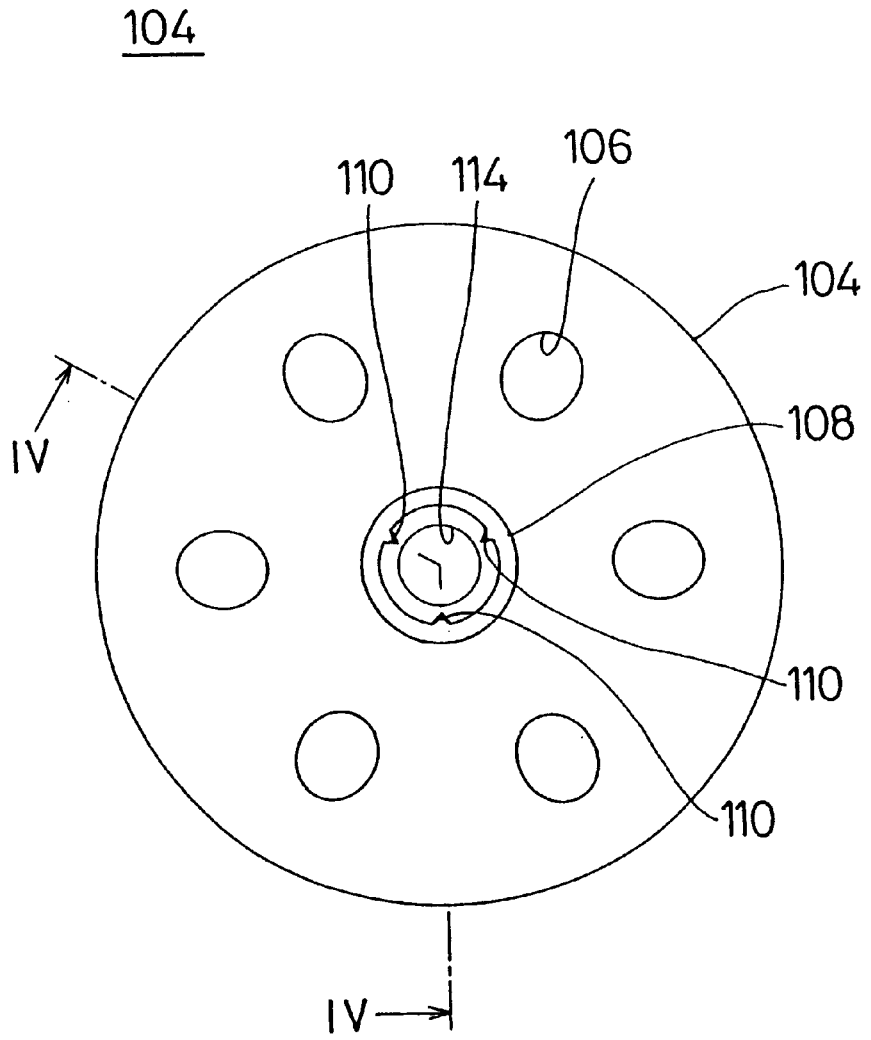
FIG. 3 is an enlarged bottom view showing a ball receiving part of the golf tee shown in FIG. 1.
Figure 4:
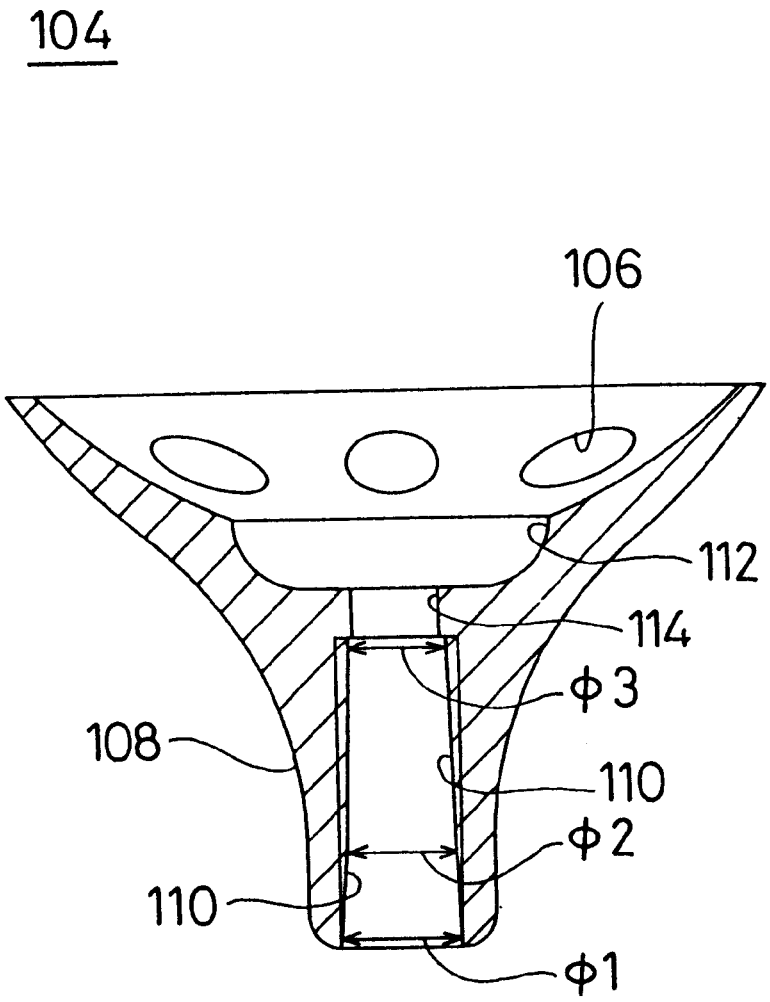
FIG. 4 is a longitudinal sectional view taken along a line IV—IV of FIG. 3.

As shown in FIGS. 2 and 4, a substantially cylindrical connection portion 108 is formed integrally with the ball receiving part 104. The base 102 and the ball receiving part 104 are preferably connected with each other by removably inserting the base 102 into the substantially cylindrical connection portion 108. A plurality of linear projection portions 110 are preferably disposed on an inner wall of the connection portion 108 such that each projection portion 110 is substantially triangular in section and extends continuously in the insertion-removal (lengthwise) direction of the base 102. The projection portions 110 are spaced at regular intervals in the circumferential direction of the connection portion 108.

The inner diameter of the projection portion 110 varies according to the position thereof. More specifically, the inner diameter 1 of the projection portion 110 is preferably about 2.8 mm in the vicinity of an open portion of the connection portion 108; the inner diameter 2 thereof is preferably about 2.5 mm at a position a little inward from the open portion of the connection portion 108; and the inner diameter 3 thereof is preferably about 2.3 mm at the innermost position of the connection portion 108. That is, the projection portion 110 is formed such that the level of the projection portion 110 becomes nearer to the innermost end of the connection portion 108, the projection height thereof from the inner wall of the connection portion 108 becomes increasingly larger. Therefore, as the level of the projection portion 110 becomes nearer to the innermost end of the connection portion 108, the inner diameter of the projection portion 110 becomes decreasingly smaller.

The thickness of the base 102 is about 2.5 mm in this preferred embodiment. As the upper end of the base 102 is pressed gradually into the connection portion 108, the projection portion 110 acts as though it bites into the base 102. Thus, the projection portion 110 tightens the periphery of the base 102 to provide a high degree of strength. Accordingly, even though there is a variety in the thickness of the base 102, the projection portion 110 can fasten the base 102 to the connection portion 108. The inner diameter of the projection portion 110 is largest in the vicinity of the open portion of the connection portion 108. Thus, the base 102 can be introduced into the connection portion 108 easily.

In the golf tee 100, there is preferably provided a through-hole 114 for communicating the ball receiving surface of the ball receiving part 104 and the interior of the connection portion 108 with each other in the thickness direction of the ball receiving part 104. In this case, the air inside of the connection portion 108 flows through the through-hole 114. Thus, it is easy to insert the base 102 into the connection portion 108 and remove it therefrom. Further, the through-hole 114 allows the base 102 to be pressed out from the connection portion 108 with a narrow needle-shaped member by inserting it into the connection portion 108 through the through-hole 114. Thus, if the base 102 is broken during use, the base 102 can be easily removed from the connection portion 108.

A concave portion 112 which is preferably substantially circular in plan view and coaxial with the ball receiving surface of the ball receiving part 104 is provided on the bottom portion of the ball receiving part 104. Even though an internal stress or other forces on the plastic occurs, the concave portion 112 prevents deformation of the ball receiving part 104 and formation of a shrink mark after molding of the material to form the ball receiving part 104.

The base 102 of the golf tee 100 shown in FIGS. 1 through 5 is preferably made of a wooden material. The ball receiving part 104 is preferably made of a biodegradably decomposable plastic material. Thus, if a golfer leaves the golf tee 100 on a golf course after use, it is possible to prevent the natural environment of the golf course from being polluted. The composition of the golf tee minimizes the amount of use of plastics which are not naturally decomposed. In consideration of protection of the natural environment of the golf course, it is preferable to use biodegradably decomposable plastics such as polycaprolactone, cellulose acetate or the like as the material of the ball receiving part 104. The base 102 is preferably shaft-shaped, and the base 102 is removable from the ball receiving part 104. Thus, the golf tee 100 can absorb an impact applied thereto when a golf ball is hit. Thus, a player can swing the head of a golf club to an appropriate extent and applies a low resistance to the golf club when the golf ball is hit. Thus, the player can hit the golf ball a long distance.

Figure 5:
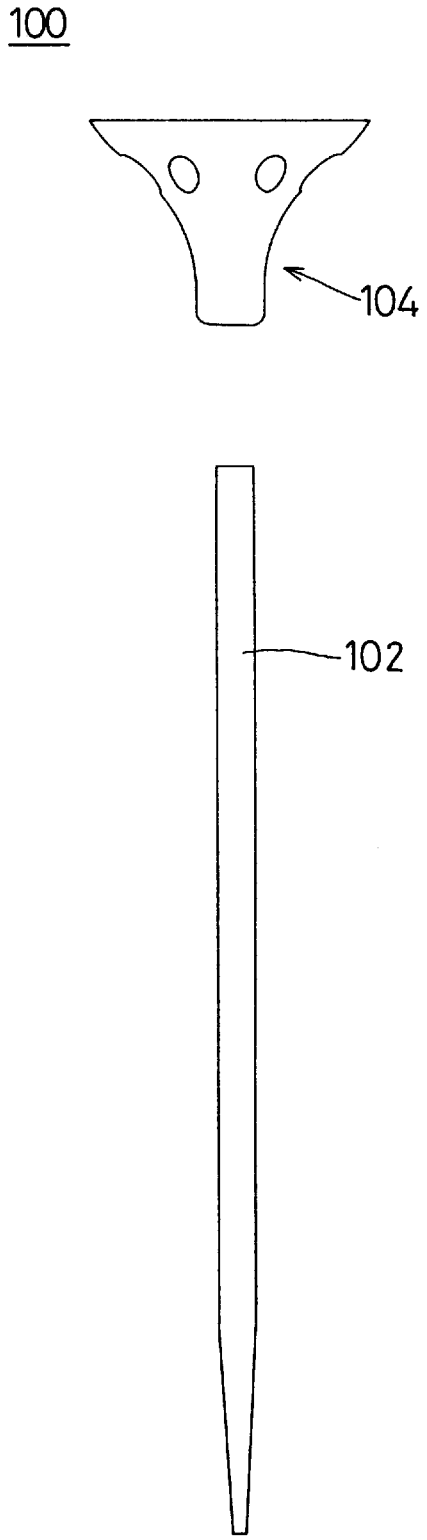
FIG. 5 is a front view showing a state in which a ball receiving part and a base of the golf tee shown in FIG. 1 are separated from each other.

Because the base 102 is removable from the ball receiving part 104, the base 102 and ball receiving part 104 can be kept and carried separately, as shown in FIG. 5 and can be assembled for use, as shown in FIG. 1. Because the base 102 is removable from the ball receiving part 104, the ball receiving part 104 can be used repeatedly by exchanging the broken base 102 with a new one. Further, because the base 102 has narrow shaft shape, the golf tee 100 left on the golf course does not damage a blade of a lawn mower.

The material used to form the base 102 is not limited to a wooden material, but it is possible to use biodegradably decomposable plastics or a material which is naturally decomposed for the base 102. As the biodegradably decomposable plastics material to be used to form the golf tee of preferred embodiments of the present invention, it is possible to use Cell Green (registered trademark) manufactured by Daicell Kagaku Co., Ltd.

Figure 6:
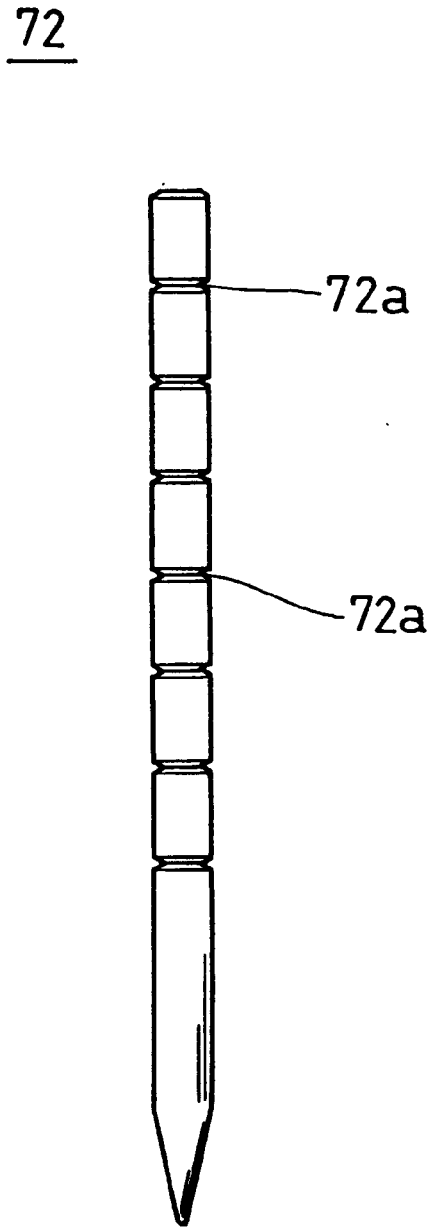
FIG. 6(A) shows a modification of the base of the golf tee shown in FIG. 1.
FIG. 6(B) shows a state in which the base of the golf tee shown in FIG. 6(A) is snapped.
Figure 6B:
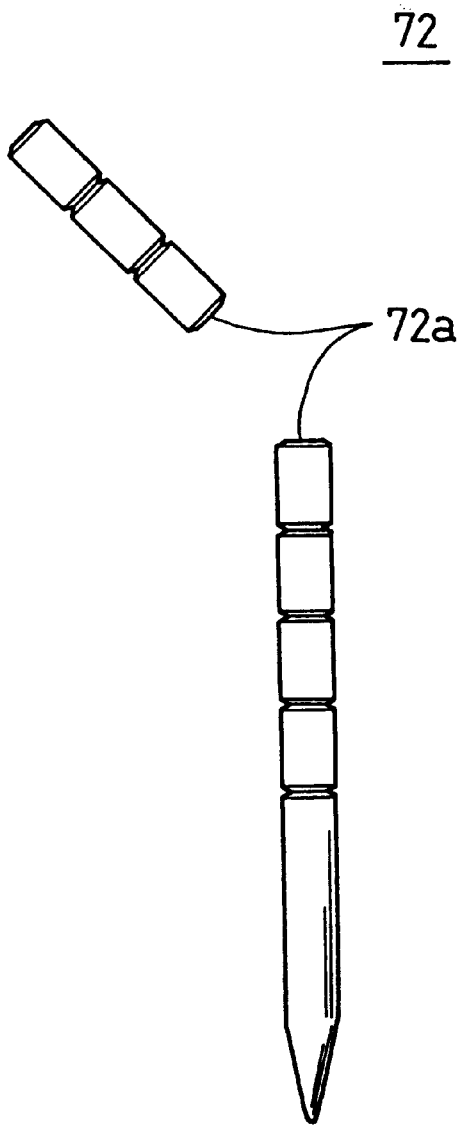

FIG. 6 shows a modification of the base 102 of the golf tee shown in FIG. 1. A ball receiving part preferably formed of a plastic material or other materials is removably installed on the upper end of a base 72, as in the case of the golf tee shown in FIG. 1. As shown in FIG. 6(A), the base 72 has a plurality of cut-out portions 72*a* disposed on its shaft portion located between its upper and lower ends at regular intervals in the lengthwise direction of the base 72 such that the cut-out portions 72*a* are substantially concave relative to the shaft portion in the circumferential direction of the base 72. The cut-out portions 72*a* are formed to allow the shaft portion snapped easily at any one of them. As shown in FIG. 6(B), a user snaps the shaft portion at any one of the cut-out portions 72*a* and install the ball receiving part on the upper end of the base 72 so that the user can tee up at a desired height and thus, hit a golf ball a long distance.

It will be apparent from the foregoing that, while the invention has been described in detail and illustrated, these are only particular illustrations and examples and the invention is not limited to these, the spirit and scope of the invention is limited only by the appended claims.

What is claimed is:

1. A golf tee comprising:

a base having a shaft-shape and adapted to be inserted into the ground at a lower end thereof; and a ball receiving part which is removably installed on an upper end of said base to support a golf ball thereon;

wherein said ball receiving part has a substantially cylindrical connection portion for connecting said ball receiving part and said base with each other, and said ball receiving part is arranged to bite into said base to securely fasten said base to said substantially cylindrical connection portion;

said substantially cylindrical connection portion includes a projection portion arranged such that as a level of said projection portion becomes nearer to an innermost end of said connection portion, a projection height thereof from an inner wall of said connection portion becomes increasingly larger; and a plurality of said projection portions are arranged to be spaced from each other along a circumference of said connection portion.

2. A golf tee according to claim 1, wherein a through-hole is arranged to communicate a ball receiving surface of said ball receiving part and an interior of said connection portion with each other in a thickness direction of said ball receiving part.

3. A golf tee according to claim 1, wherein said ball receiving part has a plurality of through-holes disposed thereon.

4. A golf tee according to claim 1, wherein said base has a plurality of cut-out portions arranged such that said base can be cut in a desired length when said golf tee is used.

5. A golf tee according to claim 1, wherein said base is made of a dyed wooden material.

6. A golf tee according to claim 1, wherein said ball receiving part has a concave portion which is substantially circular in a plan view and coaxial with a ball receiving surface of said ball receiving part disposed on a bottom portion of said ball receiving part.

7. A golf tee according to claim 1, wherein said plurality of projection portions are substantially triangular in section such that points of said substantially triangular section bite into said base.

8. A golf tee according to claim 1, wherein said ball receiving part is made of biodegradably decomposable plastics.

* * * * *